United States Patent [19]

Balkus, Jr.

[11] 4,004,318

[45] Jan. 25, 1977

[54] EDGE GUIDE ATTACHMENT FOR A PAINT BRUSH

[76] Inventor: Carl E. Balkus, Jr., 147 Deepwood Drive, Amston, Conn. 06231

[22] Filed: Sept. 25, 1975

[21] Appl. No.: 616,579

[52] U.S. Cl. ..... 15/248 R

[51] Int. Cl.[2] ..... A46B 17/00; B44D 3/22

[58] Field of Search ..... 15/166, 246, 248 R, 15/248 A, 111, 113; 33/39 B, 41 F; 401/48, 193

[56] References Cited

UNITED STATES PATENTS

| | | | |
|---|---|---|---|
| 800,707 | 10/1905 | Becker | 33/41 F |
| 1,175,809 | 3/1916 | Quigg | 15/246 |
| 2,078,193 | 4/1937 | Campbell | 15/166 |
| 2,537,468 | 1/1951 | Lanius | 15/248 R |
| 2,584,504 | 2/1952 | Seeber | 15/248 R X |
| 2,717,407 | 9/1955 | Hanhart | 15/246 |
| 3,172,140 | 3/1965 | Burns et al. | 15/166 |
| 3,337,894 | 8/1967 | Compton | 15/248 X |

FOREIGN PATENTS OR APPLICATIONS

| | | | |
|---|---|---|---|
| 915,308 | 7/1946 | France | 33/39 B |
| 209,374 | 1/1924 | United Kingdom | 33/41 F |

*Primary Examiner*—Daniel Blum
*Attorney, Agent, or Firm*—McCormick, Paulding & Huber

[57] ABSTRACT

An attachment is disclosed for assembly with a conventional paint brush, and more particularly with the metallic collar of the paint brush used to assemble the bristles with the handle portion. A clamp assembly comprising front and rear plates attached to the collar and defines upwardly projecting pintles for pivotally receiving a hinge pin oriented parallel to the free edge of the bristles. A guard is pivotally mounted to the pin and has a bevelled free edge which is located adjacent to the free edge of the bristles in order to serve as a guide for striking a painted line or the like. The bias of a small compression spring must be overcome to urge the free edge of the guard against the bristles, and the guard can be pivoted to an inactive position in order to permit the user to insert the brush in a paint can of the like in a conventional manner.

6 Claims, 4 Drawing Figures

EDGE GUIDE ATTACHMENT FOR A PAINT BRUSH

SUMMARY OF THE INVENTION

This invention relates generally to attachments for conventional type brushes, and deals more particularly with an edge guide attachment for such a brush, which guide can be pivoted to an inactive position in order to fill the brush with paint from a conventional paint can or the like.

The general object of the present invention is to provide an attachment for a conventional brush such that a paint free edge guide is provided adjacent the free edge portion of the paint brush bristles in order to facilitate the striking of a painted line either at the junction of two walls, or any where that a straight line must be painted either by a skilled painter or by one less trained in this art.

In carrying out the present invention this disclosure provides for a clamp assembly to be mounted to the metallic collar portion of a conventional paint brush, and a hinged guard is provided on the clamp assembly such that the free edge of the guard serves as a guide when the guard is moved into its active position adjacent the bristles of the brush, and which guard can be pivoted to an inactive position in order to allow the brush to be replenished with paint from a conventional paint can. In order to prevent the guard from accumulating paint when the device is not actually in use, a small spring is provided between the clamp assembly and the guard to hold the guard in a ready position. The force of the spring can be overcome by the user simply by pressing upon the guard and urging the guard toward the paint brush bristles when the brush with the attachment is actually used to strike a painted line.

DETAILED DESCRIPTION

Figure 1:
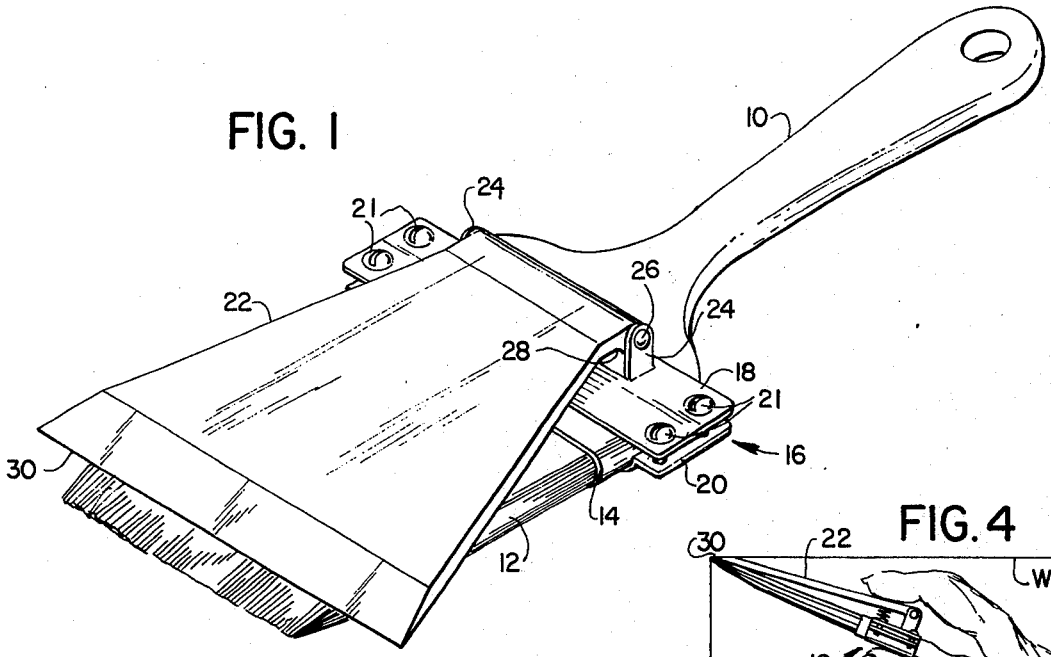
FIG. 1 is a perspective view of a conventional paint brush equipped with an attachment of the present invention.

Turning now to the drawings in greater detail, FIG. 1 shows a conventional paint brush including a handle portion 10, a bristle portion 12 and a metal collar 14 of the type commonly used to secure the bristles 12 to the handle portion 10.

Figure 2:
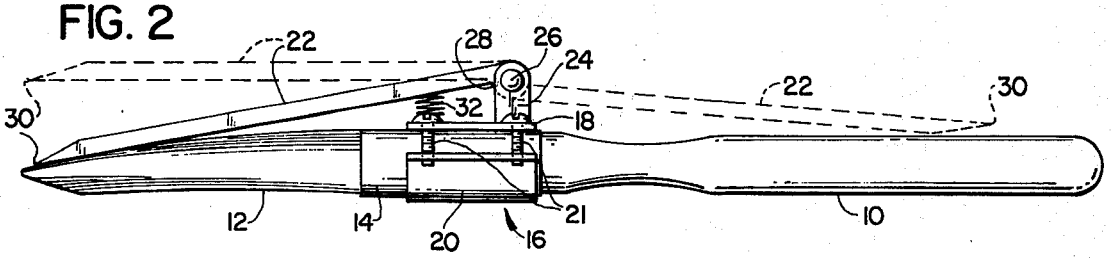
FIG. 2 shows the paint brush and the attachment depicted in FIG. 1 in a side elevational view, and with the guard being there illustrated in three alternative positions, the solid line position being that which corresponds to the FIG. 1 position of the guard portion of the device, and the broken line positions representing alternative positions therefore.

In accordance with the present invention a guide is provided for attachment to the collar portion of the conventional paint brush, and the edge guide depicted in FIG. 1 comprises a clamp assembly 16 which includes an upper plate 18 having aligned openings for receiving screws 21, 21 adjacent the projecting end portions of the upper plate 18, which screws are adapted to be received in aligned openings provided for this purpose in the projecting end portions of the lower plate 20. The upper plate 18 may be of generally flat sheet metal stock as best shown in FIG. 2, and the rear plate 20 may be of similar material, but is slightly bent into a generally channel shape to partially encircle the collar 14. The depth of the channel shape is preferably such that sufficient space is provided in order that the screws 21, 21 may conveniently accommodate brushes of different thickness.

Still with reference to the clamp assembly, the upper plate 18 also serves to define a part of a hinged joint, the mating part for such hinged joint being defined at one end of the generally trapezoidally-shaped guard member 22. More particularly, the first mentioned part of said hinged joint comprises upwardly projecting tangs 24, 24 which tangs may be upset from the initially flat member 18 and provided with aligned openings for receiving a hinge pin 26. The hinge pin 26 also passes through aligned openings in rearwardly projecting flanges 28 adjacent the said one end of the guard 22. As so constructed and arranged the guard 22 can be moved from the rest position illustrated in broken lines in FIG. 2 generally clockwise as viewed in FIG. 2 so as to occupy an inactive position also illustrated in broken lines in FIG. 2 which inactive position will permit the brush bristles with the attachment in place to be readily inserted into an upwardly open paint can or the like replenishing the supply of paint on the bristles of the paint brush, without applying paint to the guard 22.

Figure 3:
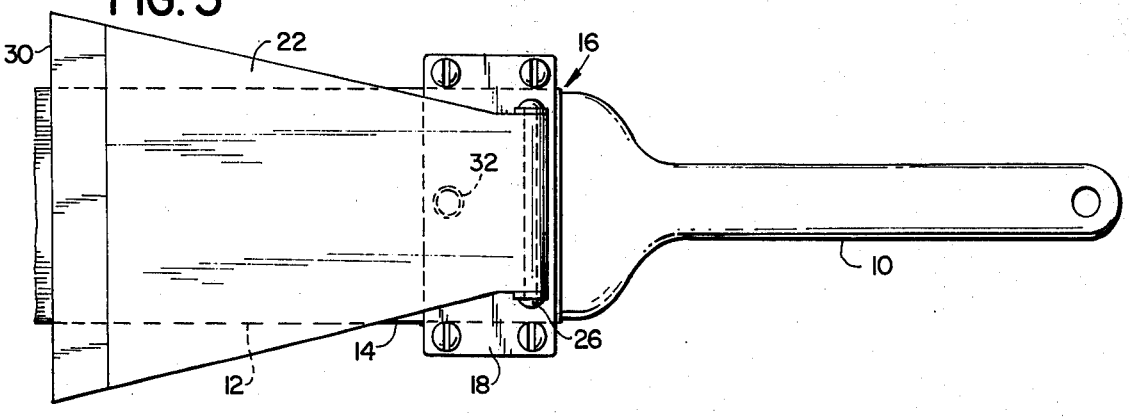
FIG. 3 is a plan view of the attachment and paint brush depicted in FIGS. 1 and 2.

Turning now to a more complete description of the trapezoidally-shaped guard 22, FIG. 3 illustrates the trapezoidal shape to best advantage, and from FIG. 3 it will be apparent that the free edge 30 of the guard 22 is somewhat longer than is the hinged end of said guard, and will also be preferably somewhat greater in linear dimension than is the free edge defined by the bristles 12. The guard 22 is also bevelled at its free edge as shown to best advantage in FIGS. 1 and 2. The guard 22 may be fabricated from sheet metal or the like, and may be conveniently formed in a stamping process so as to minimize its weight. Alternatively, the guard 22 may be fabricated from a plastic material impervious to the various paints with which the device is intended to be used.

Figure 4:
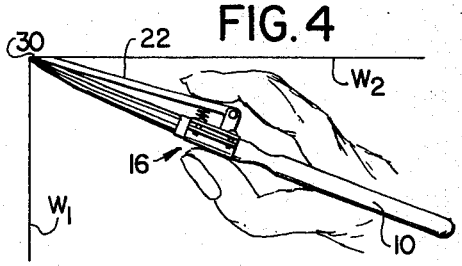
FIG. 4 is an elevational view of the device actually in use, and illustrates the configuration of the guard with reference to the paint brush and two intersecting walls, the device there illustrated being used to paint the wall W1, without applying paint to the adjacent wall W2.

In use, the guard 22 is adapted to be moved from its ready position illustrated at the left side of FIG. 2 generally downwardly toward the bristles 12 so as to partially deflect the same in order to at least approximately align the free edge 30 of the guard 22 with the free edge defined by the bristles 12. A coil compression spring 32 is preferably provided between the upper face of the upper plate member 18 and the under side of the guard 22 and in generally spaced relationship to the hinge line defined by the pin 26 so as to support the guard member 22 in its ready position, and the force of the spring 32 is easily overcome by the user with his thumb as best shown in FIG. 4 when striking a painted line, either at the intersection between the two walls W1 and W2, or wherever such a straight or even paint line is to be struck. The spring 32 is secured to the plate 18. As so constructed and arranged the free edge of the guard provides the user with a convenient paint shield at one side of his brush in order to permit him to strike a straight line of paint with the bristles of his brush. Further, the guard can be pivoted to an inactive position for replenishing the supply of paint in the brush. A further advantage to the present invention resides in the fact that the guard is given an intermediate or ready position where the guard is out of contact with the brush especially when the brush is provided with a supply of paint. Thus, the actual contact between the guard and the bristles of the brush only occurs when the device is in active use by the painter. This effectively minimizes the quantity of paint picked up by the guard and thereby contributes to its efficient operation. A further advantage of the present invention can be attributed to the fact that the guard 22 is movable away from the bristles and can be so arranged as to permit the guard itself to be dipped into a suitable solvent for removing any paint build-up on the guard during use. This can be accomplished without having to also dip the bristles in solvent, or requiring any disassembly of the attachment from the paint brush. In short, the guard may be so cleaned simply by inverting the assembly from the position shown in FIG. 2 in order to allow the guard 22 to hang downwardly. Further advantages of the present invention will be apparent to those skilled in the art and the scope of my invention is intended to be covered by the appended claims.

I claim:

1. An edge guide for a paint brush having a handle, and bristles clamped to the handle by a collar portion, said guide comprising:

a. a clamp assembly adapted for attachment to the collar portion of the paint brush and defining a first part of a hinged joint, b. a guard defining a second mating part of said hinged joint adjacent one end thereof, said guard having an opposite end with a free edge parallel the hinge line, which hinge line is so located that the guard is movable between an inactive position along side the handle substantially parallel thereto and a ready position along side the bristles, c. a coil spring having one end acting on said guard in spaced relation to said hinge line and the other end acting on said clamp assembly at least when said guard is in its ready position, said one end of said spring abutting said guard when said guard is in said ready position, said other end of said spring secured to said clamp assembly, d. said guard being movable against the force of said spring and toward the brush bristles so that said free edge of said guard provides the user with a paint shield at one side of his brush to permit him to strike a straight line of paint with his brush, and the guard being free of the spring when swung to the inactive position.

2. The combination defined in claim 1 wherein said clamp assembly comprises a front plate and a rear plate adapted for mounting on opposite sides of said paint brush collar portion, and mounting screws extending across projecting portions of said plates to secure said plates to the collar portion therebetween.

3. The combination defined in claim 2 wherein said front plate includes projecting tangs having aligned openings therein, and said clamp assembly further including a pivot pin in said aligned openings, said pin and tangs defining said first part of said hinged joint.

4. The combination defined in claim 3 wherein said second mating part of said hinged joint comprises rearwardly projecting flanges on said one end of said guard, said flanges defining aligned openings for receiving said hinge pin.

5. The combination defined in claim 4 wherein said spring comprises a coiled compression spring having said other end secured to said front plate.

6. The combination defined in claim 5 wherein said guard is generally trapezoidal in plan form, the smaller side comprising said one end with said rearwardly projecting flanges, said free edge being bevelled slightly.

* * * * *